US009267224B2

(12) United States Patent
Chen et al.

(10) Patent No.: US 9,267,224 B2
(45) Date of Patent: Feb. 23, 2016

(54) LAUNDRY PROCSSING APPARATUS

(71) Applicant: BSH BOSCH UND SIEMENS HAUSGERATE GMBH, München (DE)

(72) Inventors: Shoufan Chen, Jiangsu (CN); Ting Dai, Jiangsu (CN); Lianhua Li, Jiangsu (CN); Xiaofeng Zhang, Jiangsu (CN)

(73) Assignee: BSH HAUSGERÄTE GMBH, Munich (DE)

( * ) Notice: Subject to any disclaimer, the term of this patent is extended or adjusted under 35 U.S.C. 154(b) by 73 days.

(21) Appl. No.: 14/351,911

(22) PCT Filed: Oct. 30, 2012

(86) PCT No.: PCT/IB2012/056014

§ 371 (c)(1),
(2) Date: Apr. 15, 2014

(87) PCT Pub. No.: WO2013/064977

PCT Pub. Date: May 10, 2013

(65) Prior Publication Data

US 2014/0250951 A1 Sep. 11, 2014

(30) Foreign Application Priority Data

Nov. 4, 2011 (CN) ..... 2011 1 0354163

(51) Int. Cl.

| | |
|---|---|
| ***D06F 25/00*** | (2006.01) |
| ***D06F 33/02*** | (2006.01) |
| ***D06F 37/30*** | (2006.01) |
| *D06F 58/28* | (2006.01) |

(52) U.S. Cl.

CPC ..... *D06F 33/02* (2013.01); *D06F 37/30* (2013.01); *D06F 37/304* (2013.01); *D06F 25/00* (2013.01);*D06F 2058/2877* (2013.01); *D06F 2202/12* (2013.01); *D06F 2204/065* (2013.01); *D06F 2204/10* (2013.01); *D06F 2212/02* (2013.01)

(58) Field of Classification Search

CPC ..... D06F 25/00; D06F 33/02; D06F 37/30; D06F 37/304; D06F 2058/2877; D06F 2202/12; D06F 2204/065; D06F 2204/10; D06F 2212/02

USPC ..... 68/3 R, 12.16, 12.17, 139, 140

See application file for complete search history.

(56) References Cited

U.S. PATENT DOCUMENTS 4,532,459 A * 7/1985 Erdman et al. ..... 318/400.2

FOREIGN PATENT DOCUMENTS

| | | |
|---|---|---|
| CN | 202181461 | 4/2012 |
| GB | 1 529 691 | 10/1978 |
| KR | 2005-0050230 | 5/2005 |
| NL | 2 001 225 | 7/2009 |

OTHER PUBLICATIONS

International Search Report for PCT/IB2012/056014, mailed Jan. 17, 2013.

International Preliminary Report on Patentability for PCT/IB2012/056014, dated Nov. 15, 2013.

* cited by examiner

*Primary Examiner* — Michael Barr
*Assistant Examiner* — Levon J Shahinian
(74) *Attorney, Agent, or Firm* — Nixon & Vanderhye P.C.

(57) ABSTRACT

The present invention provides a laundry processing apparatus (100), which includes: a laundry processing drum (22), used for holding laundry for processing; a driving system (30), used for driving the laundry processing drum (22) to process the held laundry; and a power control system (10), at least used for providing power of a grid for the driving system (30), where the power control system (10) includes an electrical storage device (11). Through the setting, when external grid power outage occur or the fluctuation of the voltage is excessively large, the power control system may switch a power storage device to supply power to the laundry processing apparatus, thereby eliminating the influence on the apparatus caused by unstable voltage of power transmitted by the grid or grid power outage, and avoiding the trouble brought to a user.

25 Claims, 3 Drawing Sheets

LAUNDRY PROCESSING APPARATUS

Figure 1:
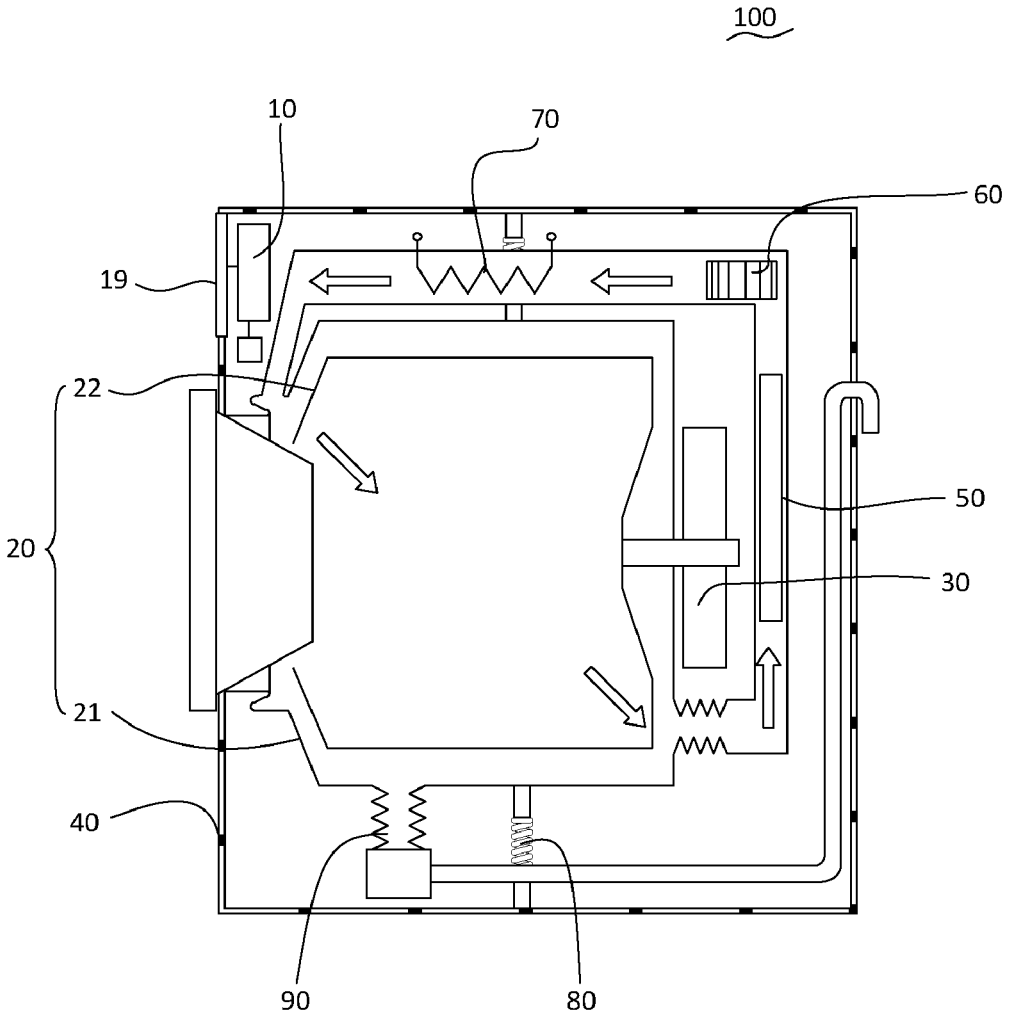

This application is the U.S. national phase of International Application No. PCT/IB2012/056014 filed 30 Oct. 2012 which designated the U.S. and claims priority to CN Patent Application No. 201110354163.6 filed 4 Nov. 2011, the entire contents of each of which are hereby incorporated by reference.

The present invention relates to a laundry processing apparatus, and in particular, to a laundry processing apparatus with a standby power supply.

A laundry processing apparatus, including a washing machine, a drying machine, and a washing and drying machine, is generally provided with an alternating current through an external grid to implement apparatus operation.

Taking the grid in China as an example, generally, the voltage distribution standard value of the power for residential use is 220 V. Accordingly, the rated voltage value of most household appliances including the laundry processing apparatus is also 220 V presently. Due to the influence of various possible uncertainties such as unstable grid transmission in a remote region, certain fluctuation occurs in the power distribution voltage, and when the fluctuation of the voltage is excessively large, it is possible to result in that electricity consumption devices in the laundry processing apparatus is influenced, and in some serious cases, it is possible to result in damages of these devices. Furthermore, when grid power outage occurs, normal use of the laundry processing apparatus is directly influenced, which is inconvenient to the user; moreover, in this case, if a door of a drum washing machine generally cannot be opened, the laundry is immersed in the washing water for a long time and cannot be taken out, thereby causing damages to the laundry.

In view of this, it is necessary to provide a laundry processing apparatus to solve the foregoing problem.

The objective of the present invention is to provide a laundry processing apparatus, the apparatus can still maintain normal operation when grid power outage occurs or the voltage of the grid is unstable.

In order to achieve the foregoing inventive objective, the present invention provides a laundry processing apparatus as defined in the attached independent claim. Preferred embodiments of the invention are subjects of dependent claims, the subsequent disclosure and the attached drawing. The features of different preferred embodiments may also combine with each other without leaving the scope of the present invention, insofar not excluded for technical reasons.

In order to achieve the foregoing inventive objective, the present invention provides a laundry processing apparatus, including:

a laundry processing drum, used for holding laundry for processing;

a driving system, used for driving the laundry processing drum to process the held laundry; and a power control system, at least used for providing power of a grid for the driving system, where the power control system further includes an electrical storage device capable of being selected to provide power for the driving system.

As an improvement of the present invention, the power control system further includes a transformer capable of being selected to provide the grid power for the driving system.

As another improvement of the present invention, the transformer is further used for providing power in a predetermined voltage range for the driving system.

As a further improvement of the present invention, the transformer and the electrical storage device are disposed in parallel, a first switch is disposed in a circuit connected to the driving system, and the first switch is capable of being controlled to electrically connect the transformer or the electrical storage device to the driving system.

As yet another improvement of the present invention, the power control system further includes a charger electrically connected to the electrical storage device and an inverter used for converting a direct current (DC) into an alternating current (AC) and electrically connected between the electrical storage device and the driving system.

As yet a further improvement of the present invention, the power control system further includes a second switch electrically connected between the electrical storage device and the inverter.

As still another improvement of the present invention, the power control system further includes a voltage detection module connected to an input end of the transformer and a controller electrically connected to the voltage detection module.

As still a further improvement of the present invention, the voltage detection module is used for detecting a voltage input into the transformer and transferring a detected voltage signal to the controller.

As again an improvement of the present invention, the controller is used for determining whether the input voltage is in a predetermined voltage range; when the input voltage is in the predetermined voltage range, the controller is further used for controlling the first switch to electrically connect the transformer and the driving system; when the input voltage exceeds the predetermined voltage range, the controller is further used for controlling the first switch to electrically connect the electrical storage device and the driving system.

As again another improvement of the present invention, the apparatus further includes a display device electrically connected to the controller; and the controller is further used for generating a display signal representing power supply of the electrical storage device and transferring the display signal to the display device when the input voltage exceeds the predetermined voltage range.

As a further improvement of the present invention, the laundry processing apparatus is a washing machine, a drying machine, or a washing and drying machine.

As again a further improvement of the present invention, the driving system includes an electric motor and a transmission belt.

As yet again an improvement of the present invention, the predetermined voltage range includes a standard voltage of grid-supplied power.

Beneficial effects of the present invention are, inter alia, as follows: through control of the power control system, when external grid power outage occurs or the fluctuation of the voltage is excessively large, the electrical storage device is switched to supply power to the laundry processing apparatus, thereby eliminating the influence on the apparatus caused by the unstable voltage of power transmitted by the grid or grid power outage, and avoiding the trouble brought to the user.

Figure 2:
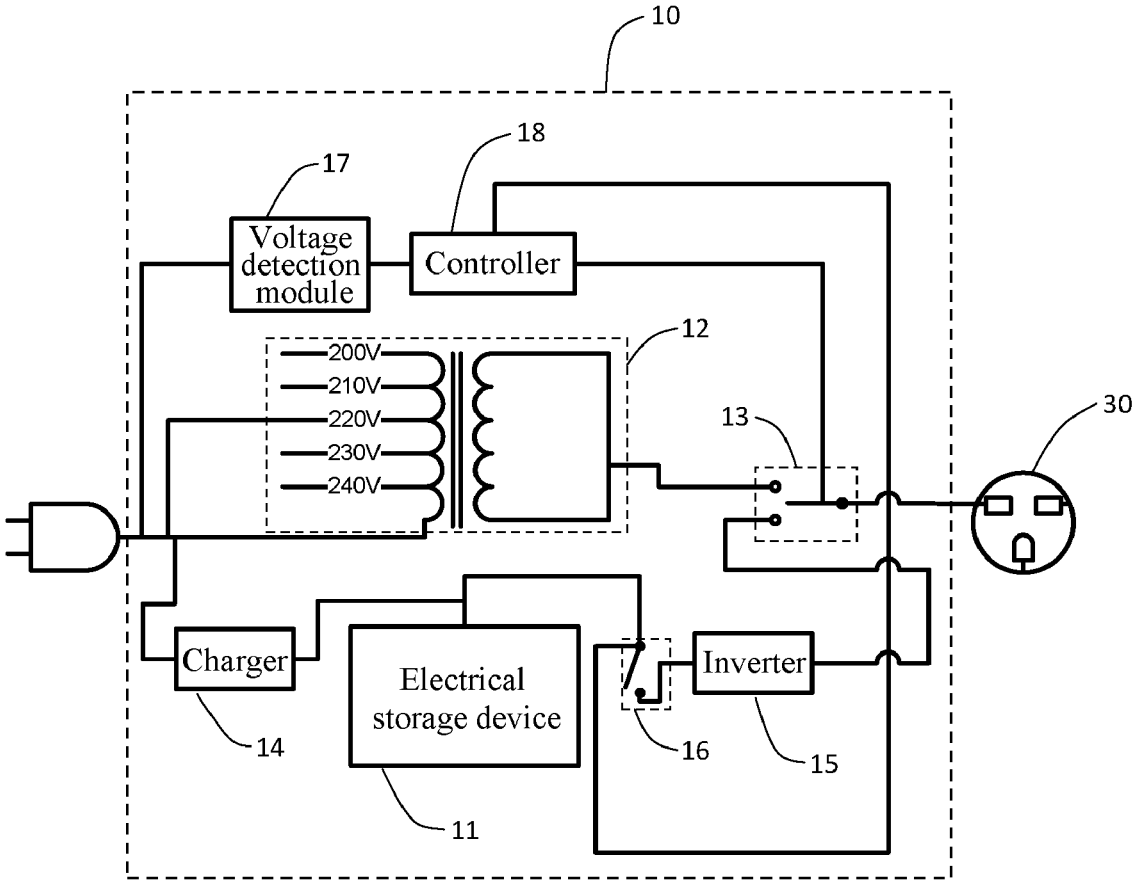
Figure 3:
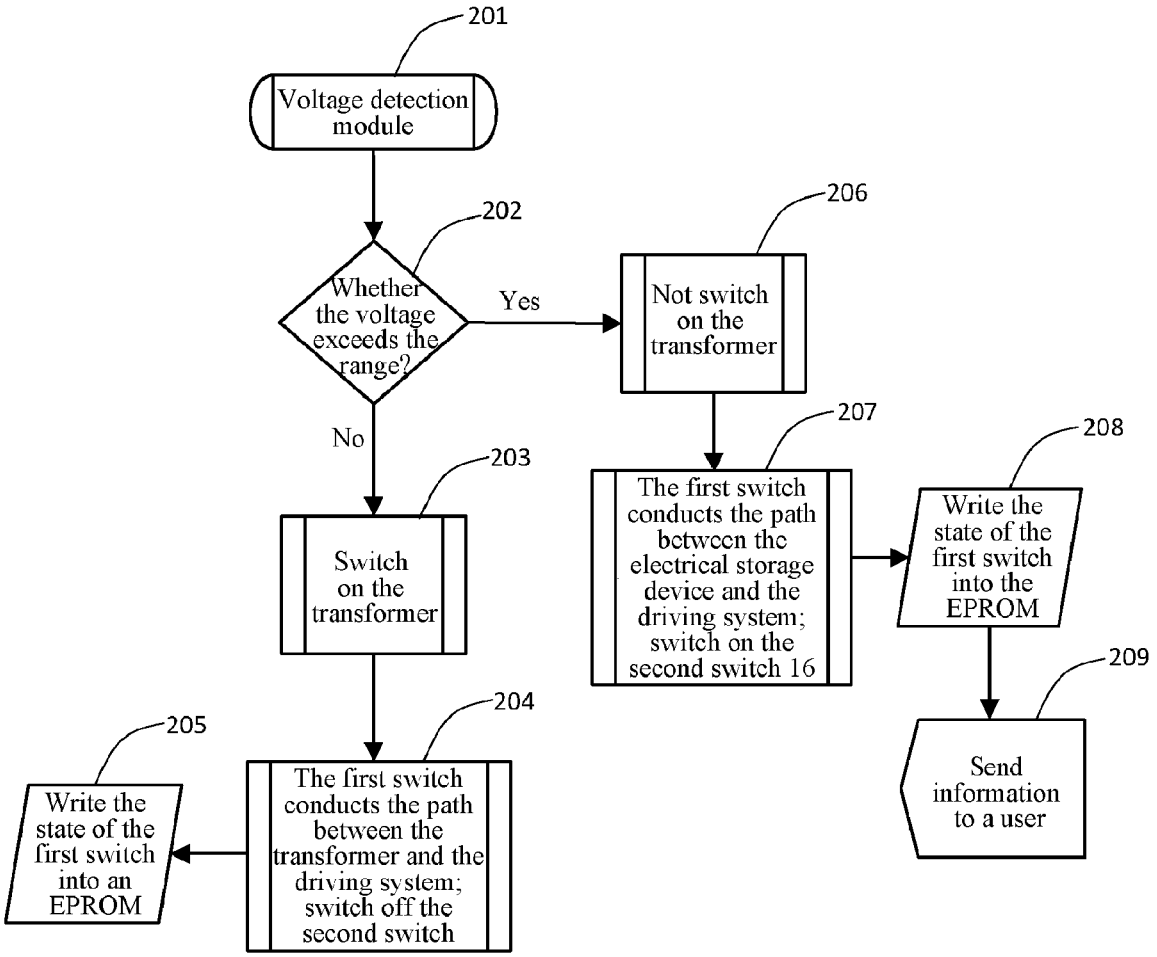

Preferred embodiments of the invention will now be elaborated upon with reference to the attached drawing. However, the embodiments shown do not limit the present invention, and changes in structure, method, or function made by persons of ordinary skill in the art based on the embodiment fall within the protection scope of the present invention. In the drawing, FIG. 1 is a schematic cross-sectional diagram of a specific embodiment of a laundry processing apparatus according to the present invention;

FIG. 2 is a schematic circuit diagram of connection between a power control system and a grid as well as a load (such as a driving system of the apparatus) in the laundry processing apparatus shown in FIG. 1; and FIG. 3 is a schematic diagram of a working process that a controller executes power control in the power control system of the laundry processing apparatus shown in FIG. 2.

The laundry processing apparatus as shown in the drawing may be a washing machine, a drying machine, or a washing and drying machine. Although the present invention is described by taking a washing and drying machine as an example in the following embodiment, persons of ordinary skill in the art should understand that, the present invention may likewise be applied to a washing machine or a drying machine.

FIG. 1 shows a specific embodiment of a laundry processing apparatus according to the present invention. In this embodiment, the laundry processing apparatus is a washing and drying machine 100, including a cabinet 40, and a washing device 20, a driving system 30, and a power control system 10 disposed in the cabinet.

The washing device 20 includes an outer drum 21, and an inner drum 22 (namely, a laundry processing drum) disposed in the outer drum. The outer drum 21 is suspended and supported in the cabinet 40 of the washing and drying machine 100 through an elastic shock-absorber 80, and generally receives water for washing during washing. The inner drum 22 is mounted in the outer drum 21 in a rotatable manner, so as to accommodate laundries to be washed and/or to be dried. Several through-holes (not shown) are generally disposed on the wall of the inner drum 22, for washing water to pass through; and several lifting ribs are generally arranged on the inner sidewall of the inner drum 22 and along the circumferential direction.

The driving system 30 generally includes an electric motor (not shown) and a transmission belt (not shown). The electric motor drives a spindle (not shown) connected onto the inner drum 22 through the transmission belt, so as to drive the inner drum 22 to rotate. In the procedure of the rotation of the inner drum, the lifting ribs disposed therein lift the laundries to a high place, and then the laundries freely fall down to pat the wall of the inner drum, thereby achieving the purpose of cleaning the laundries.

In this embodiment, a condensation system 50 and a drying system are further disposed in the cabinet 40. The condensation system 50, the drying system and the inner drum 22 are in air connection, thereby defining an airflow cycling passageway. The condensation system 50 is disposed at a side of the outer drum 21, and may adopt a common water cooling or air condensation. In this embodiment, the condensation system adopts the air condensation, namely, a heat sink is disposed in the condensation channel, and airflow channels arranged in a staggered manner are disposed in the heat sink for outside air and wet air discharged from the inner drum to pass in a staggered manner, so as to achieve heat exchange. By means of this structure, moisture in the wet air is condensed, and the wet air becomes into dry air.

The drying system is disposed above the outer drum 21, and includes an air flue (not shown), and a fan 60 and a heater 70 disposed in the air flue. After being driven by the fan 60, the wet air in the inner drum 22 enters the condensation system 50 and becomes into dry hot air after being condensed, subsequently enters the air flue and becomes dry hot air after being heated by the heater 70, and then enters the inner drum 22 again. Through such a cycle, the laundries in the inner drum 22 are gradually dried.

A drainage system 90 is connected to the bottom of the outer drum 21, and is used for discharging the washing water out of the cabinet 40 of the washing and drying machine 100.

Referring to FIG. 2, the power control system 10 includes a transformer 12. In this embodiment, the transformer 12 may provide power in a predetermined voltage range for the driving system 30. The predetermined voltage range includes the standard voltage of the grid-supplied power, and generally fluctuates around the standard voltage value by a certain voltage value. In this embodiment, the standard voltage of the grid-supplied power is 220 V, and the transformer 12 may regulate the connection of a transformer coil, so as to provide the grid power with the voltage range being from 220 V to 240 V for the driving system 30. Definitely, the above description takes China as an example, while in other regions, such as USA and Japan, the standard voltage is 110 V.

The power control system 10 further includes an electrical storage device 11 disposed in parallel to the transformer 12. The electrical storage device 11 may be a chemical battery such as a lead-acid battery or a lithium battery, and may also be an energy storage element in another form, such as an energy storage capacitor. For the transformer 12 and the electrical storage device 11, a first switch 13 is disposed in a circuit connected to the driving system 30, and the first switch 13 is capable of being controlled to electrically connect the transformer 12 or the electrical storage device 11 to the driving system 30. For example, when grid power is supplied to the driving system 30 through the transformer 12, the electrical storage device 11 and the driving system 30 are disconnected, and vice versa.

The first switch 13 is substantially a converting switch, and may be used for selectively conducting any one of two or more than two current paths. In this embodiment, the first switch 13 is a single-pole double-throw switch.

The power control system 10 further includes a charger 14 and an inverter 15 that are electrically connected to the electrical storage device 11. The charger 14 is used for converting the alternating current provided by the grid power into the direct current and transmitting the direct current to the electrical storage device 11 for storage. The inverter 15 is electrically connected between the electrical storage device 11 and the driving system 30, and is used for converting the direct current output by the electrical storage device 11 into the alternating current and providing the alternating current to the driving system 30.

The power control system 10 further includes a second switch 16 connected between the electrical storage device 11 and the inverter 15. The second switch 16 is capable of being controlled to connect or disconnect the electrical storage device 11 and the inverter 15. In this embodiment, the second switch 16 is used for disconnecting the electrical storage device 11 and the inverter 15 when the electrical storage device 11 does not serve as a power supply, thereby avoiding discharge of the electrical storage device 11. Definitely, in other embodiments, the second switch 16 may also be omitted.

The power control system 10 further includes a voltage detection module 17 connected to an input end of the transformer 12 and a controller 18 electrically connected to the voltage detection module 17. The voltage detection module 17 is used for detecting a voltage input into the transformer 12 and further transferring a detected voltage signal to the controller 18.

The controller 18 is used for determining whether the input voltage is in a predetermined voltage range; when the input voltage is in the predetermined voltage range, the controller 18 is further used for controlling the first switch 13 to electrically connect the transformer 12 and the driving system 30; when the input voltage exceeds the predetermined voltage range, the controller 18 is further used for controlling the first switch 13 to electrically connect the electrical storage device 11 and the driving system 30, and in this case, the electrical storage device 11 supplies power to the driving system 30. It should be understood that, the "exceeding the predetermined voltage range" mentioned herein includes that grid power outage occurs.

Referring to FIG. 1, the washing and drying machine 100 of this embodiment further includes a display device 19 electrically connected to the controller 18. When the input voltage exceeds the predetermined voltage range, the controller 18 may generate a display signal representing power supply of the electrical storage device 11 and transfer the display signal to the display device 19, and subsequently the display device 19 displays the display signal to the user.

FIG. 3 is a schematic diagram of a working process that the controller 18 executes power control in this embodiment.

Firstly, the controller 18 obtains a voltage signal of a transformer input end that is detected by the voltage detection module 17 (step 201), and determines whether the input voltage exceeds the predetermined voltage range (step 202), where the predetermined voltage range may be from 220 V to 240 V.

If the input voltage does not exceed the predetermined voltage range, the controller 18 determines that the transformer 12 is switched on (step 203), and then controls the first switch 13 to conduct the current path between the transformer 12 and the driving system 30, and the second switch 16 is maintained to be switched off (step 204). In this case, the electrical storage device 11 is in a charging state, and meanwhile, the controller 18 writes the state of the first switch 13 into an EPROM for recording (step 206).

If the input end voltage exceeds the predetermined voltage range, the controller 18 determines that the transformer 12 is not switched on (step 207), the first switch 13 conducts the current path between the electrical storage device 11 and the driving system 30, and controls the second switch 16 to be switched on (step 208). In this case, the direct current output by the electrical storage device 11 is converted into the alternating current through the inverter, and power is supplied to the driving system 30; meanwhile, the controller 18 writes the state of the first switch into the EPROM (step 210), generates a display signal representing power supply of the electrical storage device according to information about the switch state, and subsequently transfers the display signal to the display device 19 to be displayed to the user (step 211).

In the foregoing embodiments of the laundry processing apparatus of the present invention, through control of the power control system, when the external grid power outage occurs or the fluctuation of the voltage is excessively large, the electrical storage device is switched to supply power to the laundry processing apparatus, thereby eliminating the influence on the apparatus caused by the unstable voltage of power transmitted by the grid or grid power outage, and avoiding the trouble brought to the user.

As for persons skilled in the art, apparently, the present invention is not limited to details of the foregoing exemplary embodiments, and the present invention can be implemented in other specific forms without departing from the spirit or basic features of the present invention. Therefore, no matter from which perspective, the embodiments should be regarded as exemplary rather than restrictive, and the scope of the present invention is limited by the appended claims rather than the foregoing description, so it is aimed to include all changes falling within the meaning and the scope of equivalent important elements of the claims in the present invention. Any accompanying drawing mark in the claims should not be construed as a limit to a related claim.

Moreover, it should be understood that, although the present specification is described according to various embodiments, it does not indicate that each embodiment only includes an independent technical solution. Such expressions in the specification are merely for clarity. Persons skilled in the art should regard the specification as a whole, and technical solutions in the embodiments can form other embodiments that can be understood by persons skilled in the art through suitable combinations.

The invention claimed is:

1. A laundry processing apparatus, comprising:

a laundry processing drum configured to hold laundry for processing;

a driving system, configured to drive the laundry processing drum to process the held laundry; and a power control system, at least configured to provide power of a power grid for the driving system, wherein the power control system further comprises an electrical storage device configured to provide power for the driving system;

wherein:

the power control system further comprises: (a) a charger electrically connected to the electrical storage device and configured to convert alternating current supplied via the power grid into direct current to charge the electrical storage device, (b) an inverter electrically connected between the electrical storage device and the driving system and configured to convert the direct current from the electrical storage device into an alternating current; and (c) a first switch to electrically connect (i) between the grid and the driving system in a first condition when input voltage from the grid is within a predetermined range, and (ii) between the electrical storage device and the driving system in a second condition when the input voltage is not within the predetermined range such that the electrical storage device provides voltage to the driving system sufficient to rotate the laundry processing drum.

2. The laundry processing apparatus according to claim 1, wherein, the power control system further comprises a transformer configured to provide the power of the power grid for the driving system.

3. The laundry processing apparatus according to claim 2, wherein, the transformer is further configured to power in a predetermined voltage range for the driving system.

4. The laundry processing apparatus according to claim 3, wherein, the predetermined voltage range comprises a standard voltage of power supplied from the power grid.

5. The laundry processing apparatus according to claim 2, wherein the transformer and the electrical storage device are disposed in parallel, and the first switch is disposed in a circuit connected to the driving system, the first switch being configured to electrically connect the transformer or the electrical storage device to the driving system.

6. The laundry processing apparatus according to claim 5, wherein the power control system further comprises a voltage detection module connected to an input end of the transformer and a controller electrically connected to the voltage detection module.

7. The laundry processing apparatus according to claim 6, wherein, the voltage detection module is configured to detect a voltage input into the transformer and to transfer a detected voltage signal to the controller.

8. The laundry processing apparatus according to claim 7, wherein, the controller is configured to determine whether the input voltage is in the predetermined voltage range; when the input voltage is in the predetermined voltage range, the controller controls the first switch to electrically connect the transformer and the driving system; when the input voltage exceeds the predetermined voltage•range, the controller controls the first switch to electrically connect the electrical storage device and the driving system.

9. The laundry processing apparatus according to claim 8, wherein, the apparatus further comprises a display device electrically connected to the controller; and the controller is configured to generate a display signal representing power supply of the electrical storage device and to transfer the display signal to the display device when the input voltage exceeds the predetermined voltage range.

10. The laundry processing apparatus according to claim 1, wherein the power control system further comprises a second switch electrically•connected between the electrical storage device and the inverter.

11. The laundry processing apparatus according to claim 1, wherein the laundry processing apparatus is a washing machine, a drying machine, or a washing and drying machine.

12. The laundry processing apparatus according to claim 1, wherein, the driving system comprises an electrical motor and a transmission belt.

13. The laundry processing apparatus according to claim 1, wherein the electrical storage device is not connected to the driving system in the first condition, and the driving system is not connected to the grid in the second condition.

14. A laundry processing apparatus, comprising:

a laundry processing drum to receive laundry;

a driving system to drive the laundry processing drum; and a power control system configured to provide power of a power grid to the driving system, wherein the power control system further comprises an electrical storage device configured to provide power for the driving system;

wherein:

the power control system further comprises: (a) a charger electrically connected to the electrical storage device and configured to convert alternating current supplied via the power grid into direct current to charge the electrical storage device, and (b) an inverter electrically connected between the electrical storage device and the driving system and configured to convert the direct current supplied by the charger to the electrical storage device into alternating current, the grid and the driving system are electrically connected in a first condition when input voltage from the grid is within a predetermined range, the electrical storage device not being connected to the driving system in the first condition, and the electrical storage device and the driving system are electrically connected in a second condition when the input voltage is not within the predetermined range, the grid not being connected to the driving system in the second condition.

15. The laundry processing apparatus according to claim 14, wherein the power control system further comprises a transformer configured to provide the power of the power grid for the driving system.

16. The laundry processing apparatus according to claim 15, wherein the transformer is configured to power in a predetermined voltage range for the driving system.

17. The laundry processing apparatus according to claim 16, wherein the predetermined voltage range comprises a standard voltage of power supplied from the power grid.

18. The laundry processing apparatus according to claim 15, wherein the transformer and the electrical storage device are disposed in parallel, a first switch is disposed in a circuit connected to the driving system, the first switch is configured to electrically connect the transformer or the electrical storage device to the driving system.

19. The laundry processing apparatus according to claim 18, wherein the power control system further comprises a second switch electrically•connected between the electrical storage device and the inverter.

20. The laundry processing apparatus according to claim 18, wherein the power control system further comprises a voltage detection module connected to an input end of the transformer and a controller electrically connected to the voltage detection module.

21. The laundry processing apparatus according to claim 20, wherein the voltage detection module is configured to detect a voltage input into the transformer and to transfer a detected voltage signal to the controller.

22. The laundry processing apparatus according to claim 21, wherein the controller is configured to determine whether the input voltage is in the predetermined voltage range; when the input voltage is in the predetermined voltage range, the controller controls the first switch to electrically connect the transformer and the driving system; when the input voltage exceeds the predetermined voltage•range, the controller controls the first switch to electrically connect the electrical storage device and the driving system.

23. The laundry•processing apparatus according to claim 22, wherein the apparatus further comprises a display device electrically connected to the controller; and the controller is configured to generate a display signal representing power supply of the electrical storage device and to transfer the display signal to the display device when the input voltage exceeds the predetermined voltage range.

24. The laundry processing apparatus according to claim 14, wherein the laundry processing apparatus is a washing machine, a drying machine, or a washing and drying machine.

25. The laundry processing apparatus according to claim 14, wherein the driving system comprises an electrical motor and a transmission belt.

* * * * *